United States Patent [19]

Dobroborsky

[11] 4,067,397

[45] Jan. 10, 1978

[54] HAND-OPERATED DEVICE FOR DRILLING BLAST-HOLES

[76] Inventor: Samuil Iosifovich Dobroborsky, ulitsa Detskaya, 17, kv. 57, Leningrad, U.S.S.R.

[21] Appl. No.: 602,261

[22] Filed: Aug. 6, 1975

[51] Int. Cl.[2] ..... E21C 9/00

[52] U.S. Cl. ..... 173/32; 175/118; 173/144

[58] Field of Search ..... 173/32, 144, 145, 146, 173/147, 112, 113; 175/114, 118

[56] References Cited

U.S. PATENT DOCUMENTS

| | | | |
|---|---|---|---|
| 2,142,529 | 1/1939 | Smith, Sr. | 173/113 X |
| 2,143,752 | 10/1939 | Azarowich | 173/32 |
| 2,227,282 | 12/1940 | Smith, Sr. | 173/146 |
| 2,675,213 | 4/1954 | Poole et al. | 173/32 X |

*Primary Examiner*—Ernest R. Purser
*Assistant Examiner*—Richard E. Favreau
*Attorney, Agent, or Firm*—Lackenbach, Lilling & Siegel

[57] ABSTRACT

The perforator body is provided with a built-in pulling winch whose drum is wound with a wire rope. The winch axle mounts a worm wheel meshing with the perforator box whose external surface is made in the form of a worm. The wire rope is secured to the rock and the perforator is fed progressively by rotation of the box.

8 Claims, 3 Drawing Figures

HAND-OPERATED DEVICE FOR DRILLING BLAST-HOLES

The present invention relates to improvements in mining equipment and, more particularly, it relates to a hand-operated device for drilling blast-holes and can be used most successfully in underground workings, particularly in those of a considerable height and in drilling downward-directed blastholes.

One of the most important problems in drilling blast holes is the provision of progressive feed of the device for drilling blast-holes. As a rule, the blast-hole drilling device comprises a perforator with a rotatable box for rotating the drilling rod and an impact tool which strikes said rod so that the latter penetrates into the rock and forms a blast-hole.

If such a device is intended for drilling horizontal and inclined blast-holes, it comprises a so-called pneumatic support set at a certain angle to the direction of drilling to ensure the required thrust provided the angle between the axis of the pneumatic support and the direction of drilling is equal or near to 180°. As this angle diminishes, the thrust ensured by the pneumatic support decreases and at an angle of 90° it drops to zero.

In drilling an ordinary face of an underground working only a small number of blast-holes can be drilled by the perforator with the pneumatic support with sufficient thrust. The remaining blast-holes are drilled with a low thrust and, consequently, at a low drilling speed. The low thrust has to be partly compensated by the physical force of the operator. This brings about working fatique while the violent vibration of the perforator caused by the insufficient thrust is detrimental to the operator's organism.

In the course of drilling the downward-directed blast-holes the thrust is constituted partly by the weight of the perforator and mainly by the muscular force of the operator.

The suggested piston-type or screw-type appliances for increasing the thrust of the perforators have not won wide application due to their bulkiness, heavy weight and undue expenditures of time for their operation.

Of late, there have been attempts to use a pulling winch in the blast-hole drilling device comprising a perforator. However, the use of the winch calls for the provision of a special drive for operating it which, in turn, increases the size and weight of the device as a whole to such a great extent that these devices have found practically no application.

An object of the present invention lies in providing a device for drilling blast-holes comprising a perforator and a pulling winch and being comparatively small and light.

Another object of the present invention lies in providing a device with a pulling winch which would possess all the inherent advantages of the hand-operated devices for drilling blast-holes comprising a perforator, i.e., simplicity of operation, mobility, etc.

These and other objects are achieved by providing a blast-hole drilling device which comprises a perforator consisting of an impact tool and a rotatable box which carries a rod with a drilling bit and a perforator-mounted pulling winch whose pulling element is secured to the solid rock wherein, according to the invention, the winch shaft is driven by the perforator box, said box being coupled with the shaft through a gear drive so that the perforator is fed by the rotating box.

Such a layout of the device dispenses with the need for an additional engine to drive the pulling winch and consequently, it becomes possible to provide a device for drilling blast-holes with the aid of a perforator and a pulling winch without increasing considerably the dimensions of the hand-operated device.

In one of the embodiments of the invention the external surface of the rotatable box in the zone of engagement is made in the form of a worm which interacts with a worm wheel mounted on the shaft of the winch drum.

It is practical for the worm wheel to be mounted on the shaft with the aid of a bushing and provision of means for pressing said wheel against the means for moving the pulling element with the purpose of adjusting the tension of the pulling element and, as a consequence, the feed of the perforator. The pulling element of the winch may be constituted by a chain or a rope and the means for moving the pulling element, by a sprocket, or a drum, respectively.

Now the invention will be described in detail by referring to a presently preferred embodiment and to the accompaying drawings, in which.

Figure 1:
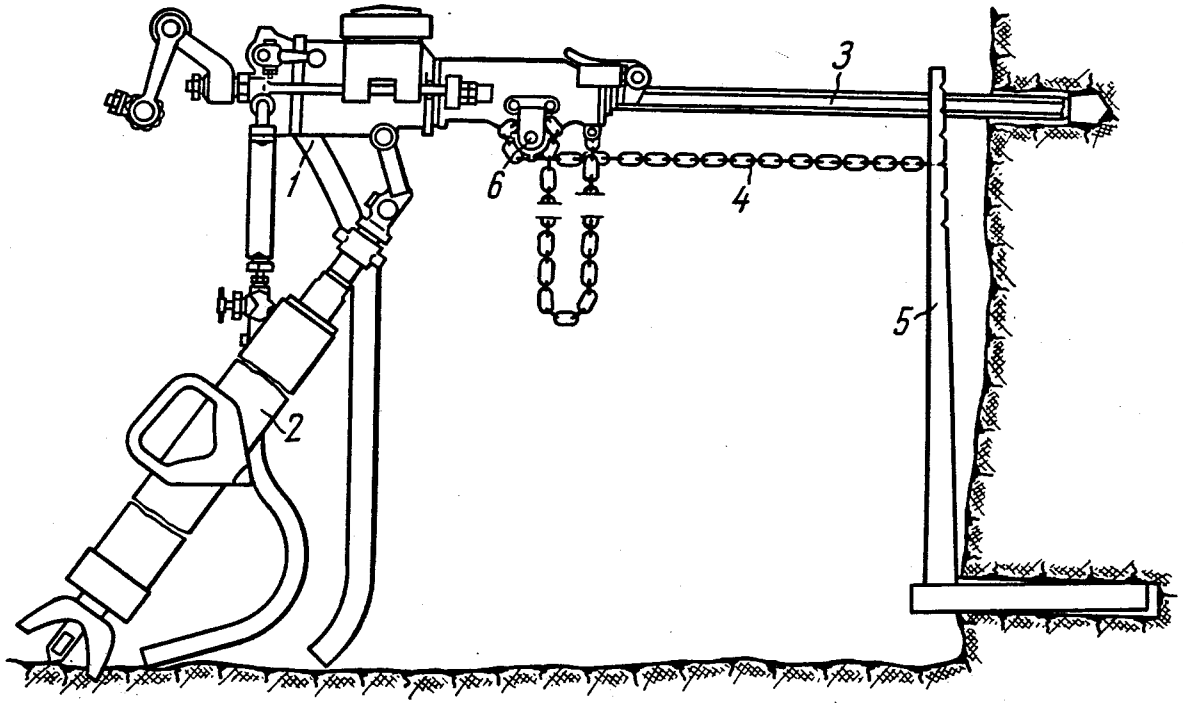
FIG. 1 is a side elevational view of the device for drilling horizontal and inclined blast-holes.

The device for drilling blast-holes illustrated in FIG. 1 is intended for drilling horizontal and inclined blast-holes and comprises a perforator 1 and a pneumatic support 2.

The perforator utilized in the device may be of any known type, e.g., the one described in U.S. Pat. No. 2,141,727. Such a perforator consists of a rotatable box 12 (not shown in FIG. 1) which carries a rod 3 with a drilling bit, and an impact tool (not shown) for delivering blows on the rod.

Built into the perforator body is a winch 6 which is connected by its pulling element 4 with an anchor.

Figure 2:
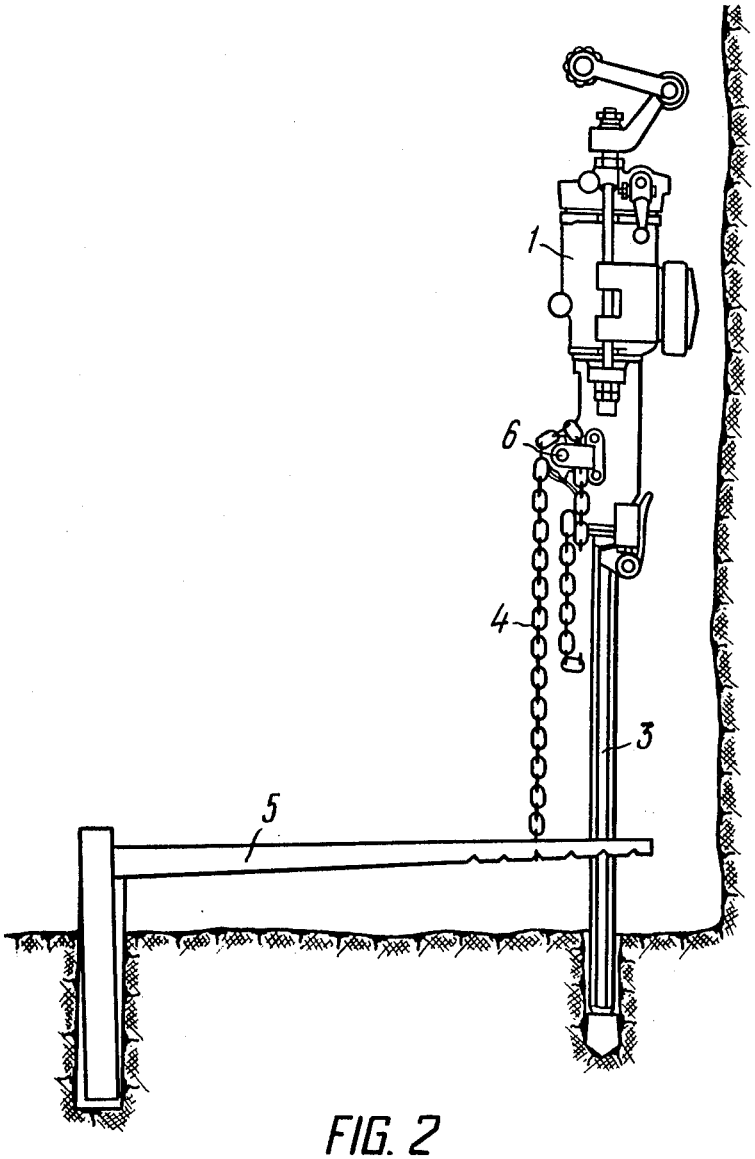
FIG. 2 is a side elevational view of the device for drilling downward-directed blast-holes.

FIG. 2 shows a device for drilling downward-directed blast-holes. This device is similar to that shown in FIG. 1 with the sole exception that it has no pneumatic support.

Figure 3:
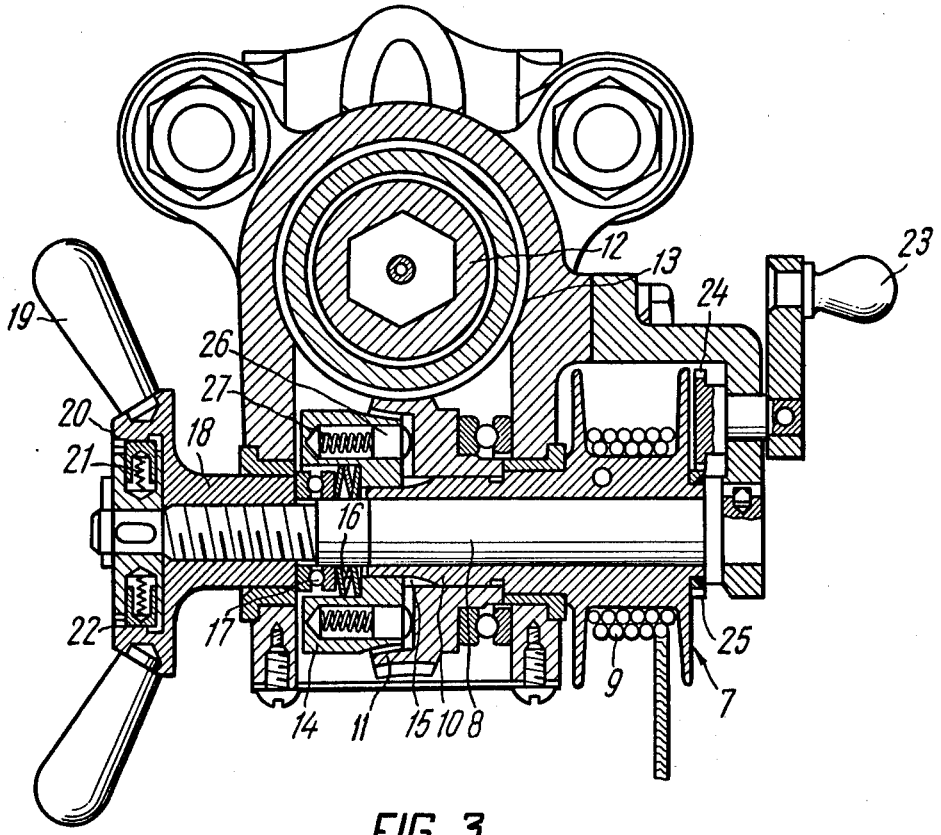
FIG. 3 is a section taken along line III—III in FIG. 1.

FIG. 3 illustrates a preferable embodiment of the perforator feed mechanism in the device for drilling blast-holes according to the present invention. The perforator is fed by the pulling winch comprising a drum 7 mounted on a shaft 8. The pulling element 9 of the winch shown in FIG. 3 is constituted by a rope or a wire rope made for example, of steel.

If the wire rope is substituted by a chain as shown in FIGS. 1 and 2, the drum must be replaced by a sprocket. It can be seen in FIGS. 1 and 2 that one end of the wire rope is secured to the rock by means of the anchor 5 while its other end (not shown in FIG. 3) is fastened to the drum. If the winch comprises a sprocket, the chain meshes with the sprocket teeth.

The drum 7 has a bushing 10 which carries a free-mounted worm wheel 11.

The external surface of the perforator rotatable box 12 is provided with a worm thread 13. The thread profiles of the worm and worm wheel 11 mesh in such a way that rotation of the box causes the worm wheel 11 to turn. In view of the fact that the worm wheel is free-mounted on the bushing 10, the device is provided with a means for engaging the drum 7 with the worm wheel 11. This means includes a friction clutch 14 connected with the bushing 10 by splines 15 and mounted on the shaft 8. The same shaft carries plate springs 16 and a thrust bearing 17.

The hold-down force is created by a pusher screw 18 rotated by a handle 19. Uncontrollable rotation of the pusher 18 is prevented by retainers 20 loaded by a spring 21, said retainers engaging internal teeth 22 in the body of the pusher screw.

Rewinding of the wire rope is effected by a handle 23 which is connected by gears 24 and 25 with the drum 7.

Disengagement of the worm wheel 11 and clutch 14 is ensured by pushers 26 with springs 27.

The device functions as follows.

The device is installed as shown in FIGS. 1 or 2. After starting the perforator, the feed mechanism is set in operation by turning the handle 19. Each revolution of the box 12 turns the worm wheel 11 and the drum 7. As the box, the worm wheel and the drum rotate, the wire rope is wound on the drum 7 and applies thrust to the perforator in the direction of drilling.

When the blast-hole has been completely drilled, the handle 19 is turned back thus disengaging the clutch and the drum after which the wire rope is rewound manually to the initial position by the handle 23.

When the pulling element is constituted by a chain, the layout of the device is identical with that described above with the only exception, as has already been stated above that the drum is replaced by a sprocket and the chain is pulled to the initial position by hand.

We have described above the presently preferred version of the device for drilling blast-holes according to the invention; however this device may be modified in any manner within the spirit and scope of the invention. Thus, the mechanism for pressing the worm wheel against the friction clutch may be modified or cancelled, or the worm wheel may be replaced by a gear drive.

The use of the present invention will increase the drilling speed two to three times and reduce vibration of the perforator handle.

I claim:

1. A hand-operated device for drilling blast holes comprising a perforator which has an impact tool and a rotatable box which carries a rod with a drilling bit; a power-operated pulling winch mounted on said perforator and having a pulling element which can be secured to solid rock, said pulling winch having a shaft on which said pulling winch is fixedly mounted; drive means in the nature of a gear drive cooperating with said rotatable box for converting the movements of said rotatable box into movements about said shaft of said pulling winch; coupling means including adjusting means for selectively coupling the movements of said drive means to said pulling winch, whereby coupling of said drive means to said pulling winch causes the perforator to be fed progressively by said rotating box, said rotatable box having an external surface, and said gear drive comprising a worm thread formed on said external surface, and a gear mounted on said shaft of said pulling winch and meshed with said worm thread in an engagement zone, whereby actuation of said rotatable box translates the movements thereof to rotary movements coaxial with said shaft of said pulling winch; and a hollow bushing on said shaft of said pulling winch, said gear being mounted on said bushing for free rotation thereon, the rotary movements of said gear only being transmitted to said bushing when said coupling means couples said worm wheel and said bushing together.

2. A device according to claim 1 wherein the pulling element is constituted by a wire rope .

3. A device according to claim 1 wherein the pulling element is constituted by a sprocket driven chain.

4. A device as defined in claim 1, wherein one end of said bushing is provided with a drum made integral therewith, said pulling element being wound on said drum.

5. A device as defined in claim 1, wherein said coupling means comprises a friction clutch movable along the winch shaft and provided for coupling and disengagement of said gear and said hollow bushing with the help of said adjusting means.

6. A device as defined in claim 1, further comprising one end of said bushing being provided with splines, said coupling means comprising a friction coupling clutch provided with splines adapted to mate with said splines of said bushing to permit said clutch to move relatively axially but not rotatably with respect to said bushing, said clutch being axially movable between engaging and disengaging positions with said gear whereby the rotary movements of said gear are selectively transmitted to said bushing and said pulling element.

7. A device as defined in claim 6, wherein said adjusting means comprises a threadedly mounted handle movable along the axial direction of said shaft of said pulling winch with rotation of said handle, said handle being adapted to urge said clutch into frictional engagement with said gear and to transmit rotation of said gear to said hollow bushing with rotation of said drum with said pulling element.

8. A device as defined in claim 7, wherein said shaft of said pulling winch carries a thrust bearing and plate springs to permit smooth adjustment of the force with which said friction clutch is pressed against said gear.

* * * * *